US007658807B2

(12) United States Patent
Friedrich et al.

(10) Patent No.: US 7,658,807 B2
(45) Date of Patent: Feb. 9, 2010

(54) HOT-ROLLED STRIP INTENDED FOR THE PRODUCTION OF NON-GRAIN ORIENTED ELECTRICAL SHEET AND A METHOD FOR THE PRODUCTION THEREOF

(75) Inventors: Karl Ernst Friedrich, Moers (DE); Wolfgang Rasim, Geldern (DE); Joergen Schneider, Bochum (DE); Rudolf Kawalla, Bobritzsch (DE); Carl-Dieter Wuppermann, Krefeld (DE)

(73) Assignee: ThyssenKrupp Steel AG, Duisburg (DE)

( * ) Notice: Subject to any disclaimer, the term of this patent is extended or adjusted under 35 U.S.C. 154(b) by 454 days.

(21) Appl. No.: 10/493,522

(22) PCT Filed: Oct. 23, 2002

(86) PCT No.: PCT/EP02/11822

§ 371 (c)(1),
(2), (4) Date: Nov. 19, 2004

(87) PCT Pub. No.: WO03/038135

PCT Pub. Date: May 8, 2003

(65) Prior Publication Data

US 2005/0067053 A1 Mar. 31, 2005

(30) Foreign Application Priority Data

Oct. 31, 2001 (DE) ..... 101 53 234

(51) Int. Cl.
*H01F 1/147* (2006.01)

(52) U.S. Cl. ..... 148/121; 148/111; 148/120; 148/306; 148/307

(58) Field of Classification Search ..... None
See application file for complete search history.

(56) References Cited

U.S. PATENT DOCUMENTS 6,503,339 B1 * 1/2003 Pircher et al. ..... 148/120

(Continued)

FOREIGN PATENT DOCUMENTS

DE 198 07 122 9/1999

(Continued)

OTHER PUBLICATIONS

English language translation of Friedrich et al. (Friedrich '691, German Document No. 100 15 691 C1, cited in the IDS submitted Apr. 24, 2004).*

(Continued)

*Primary Examiner*—John P. Sheehan
(74) *Attorney, Agent, or Firm*—Proskauer Rose LLP

(57) ABSTRACT

The present invention relates to a hot-rolled steel strip for further processing to form non-grain oriented electrical sheet with the following composition (in % by weight) C: <0.02%, Mn: ≦1.2%, Si: 0.1-4.4%, Al 0.1-4.4%, wherein the sum formed from the Si content and twice the Al content is <5%, P: <0.15%, Sn: ≦0.20%, Sb: ≦0.20%, the remainder iron and unavoidable impurities, with a strip thickness which is at most 1.8 mm, and with a partially softened structure which is characterised by a high intensity for the α fibre (fibre representation of orientation distribution functions) in the region of 0° to 60°, wherein the ratio $I_{112}/I_{001}$ formed from the intensity $I_{112}$ of the position (112) <110> to the intensity $I_{001}$ of the position (001) <110> is >0.4 and the ratio $I_{111}/I_{001}$ formed from the intensity $I_{111}$ of the position (111) <110> to the intensity $I_{001}$ of the position (001) <110> is >0.2.

8 Claims, 1 Drawing Sheet

U.S. PATENT DOCUMENTS

Figure 2:
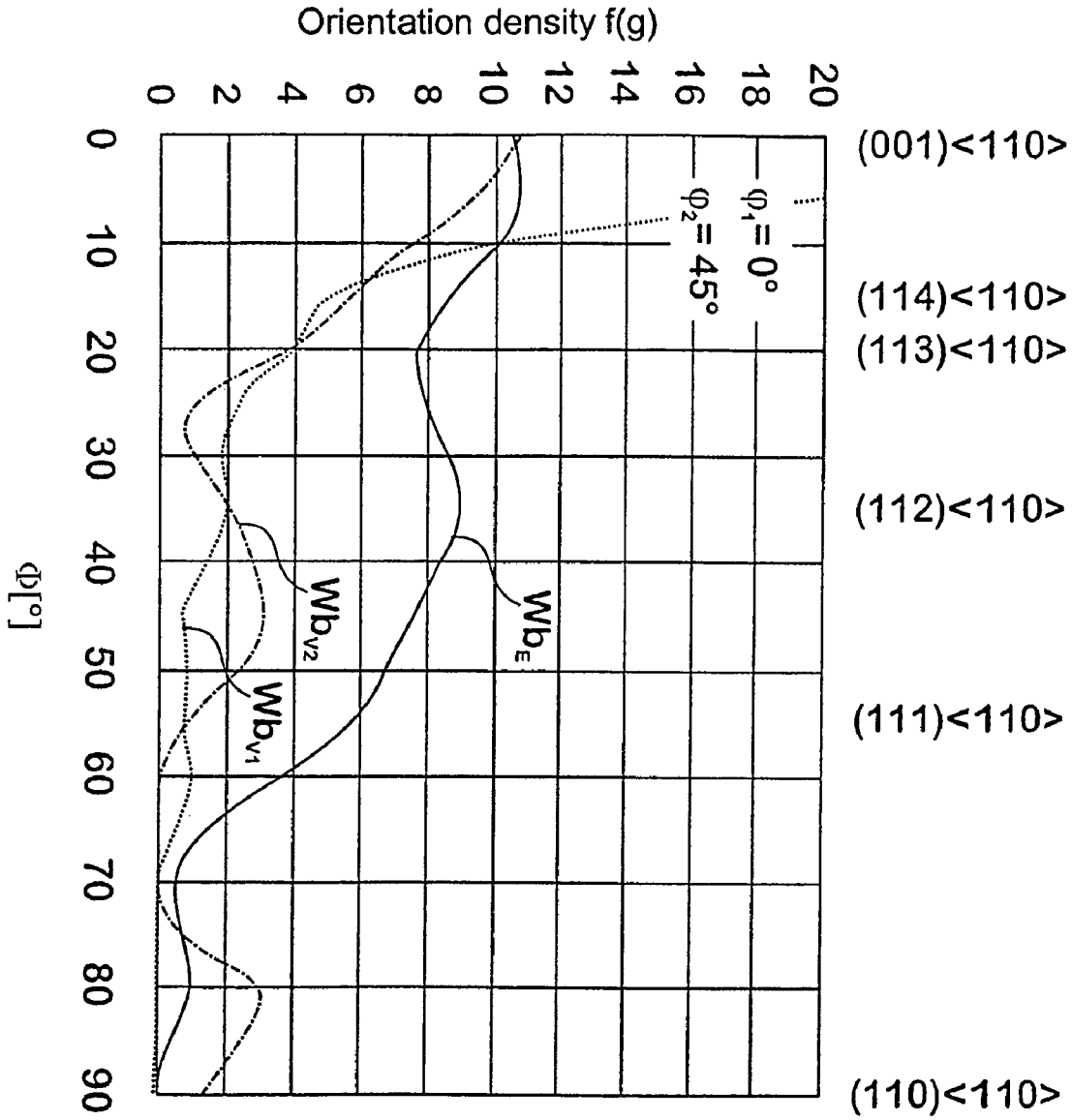

| | | | | |
|---|---|---|---|---|
| 6,767,412 | B2 * | 7/2004 | Friedrich et al. | 148/121 |
| 6,773,514 | B1 * | 8/2004 | Kawalla et al. | 148/121 |
| 2003/0188805 | A1 * | 10/2003 | Friedrich et al. | 148/111 |
| 2004/0016530 | A1 * | 1/2004 | Schoen et al. | 164/476 |
| 2004/0149355 | A1 * | 8/2004 | Kohno et al. | 148/111 |

FOREIGN PATENT DOCUMENTS

| | | | |
|---|---|---|---|
| DE | 100 15 691 | | 7/2001 |
| EP | 0 377 734 | | 7/1990 |
| JP | 2001-123225 | * | 5/2001 |
| WO | WO 01/02610 | A1 * | 1/2001 |
| WO | WO 01/68925 | A1 * | 9/2001 |

OTHER PUBLICATIONS

Hendricks C. et al.: "Commissioning and First Results of the Casting Rolling Plant of Thyssen Krupp Stahl AG", Feb. 15, 2000, pp. 61-68, Stahl Und Eisen, Verlag Stahleisen GmbH, Düsseldorf, DE.

* cited by examiner

HOT-ROLLED STRIP INTENDED FOR THE PRODUCTION OF NON-GRAIN ORIENTED ELECTRICAL SHEET AND A METHOD FOR THE PRODUCTION THEREOF

BACKGROUND OF THE INVENTION

The invention relates to a hot-rolled steel strip intended for the production of electrical sheet and a method for the production thereof.

In this context, the term "non-grain oriented electrical sheet" is taken to mean a steel sheet or a steel strip which regardless of its texture comes under the sheets mentioned in DIN 46 400 Part 1 or 4 and the loss anisotropy of which does not exceed the maximum values established in DIN 46 400 Part 1. The terms "sheet" and "strip" are used synonymously here.

The production of non-grain oriented electrical sheet (NO electrical sheet) conventionally comprises the steps:

melting the steel, casting the steel to form slabs, if necessary, reheating the slabs, using the slabs in a hot-rolling line, pre-rolling the slabs, finishing hot-rolling of the slabs to form a hot strip, of which the end thickness is between 1.8 mm and 5 mm, typically between 2 mm and 3 mm, annealing and pickling of the hot strip wherein these hot strip treatments can be carried out as combined annealing pickling, cold-rolling to an end thickness in the region of 0.75 mm to 0.35 mm or smaller or, if necessary, cold-rolling of the hot strip to end thickness taking place in multi-stages with interposed annealing, and final annealing of cold strips of this type in end thickness, which have been cold-rolled with a degree of total deformation of at least 65%, or annealing and subsequent rerolling with a degree of total deformation of at most 20%.

The softening of the structure of the steel is achieved by a recrystallization, which is effected in the course of the cold rolling. In practice, a total deformation of >65% is required to achieve the conventional end thicknesses of the finished product, "cold-rolled non oriented electrical strip." The starting point of the cold rolling is a hot strip with a thickness of ≧1.8 mm and the end thickness of the finished product is between 0.35 to 0.75 mm. Characteristic of a softened structure is an intensity distribution of the α fibre texture such that an increased intensity of the component (112) <110> occurs and the cold-rolling component (001) <110> is largely removed.

Therefore the cold-rolling with these high degrees of total deformation creates the prerequisite for the possibility of using a final annealing, which is conventional nowadays, in the form of a "short-time annealing" (through-type furnace—short times of high temperatures for the strip) with the aim of achieving a softened structure and an optimum grain size in the finished product "cold-rolled NO electrical strip".

The large number of working steps to be carried out in a conventional procedure of this type leads to high expenditure in terms of apparatus and costs. Therefore recently increased efforts have been made to design the casting of the steel and subsequent rolling processes in the hot strip production such that a hot strip with a thickness of ≦1.8 mm is produced. One way to achieve this aim is a continuous sequence of the casting and rolling process dispensing with the reheating and the pre-rolling.

For this purpose, so-called "casting/rolling plants" have been developed and set up. In these devices also known as "CSP plants", the steel is cast to form a continuously drawn billet (thin slab) which is then hot-rolled "in-line" to form hot strip. The experiences obtained in operating casting/rolling plants and the advantages of the casting/rolling carried out "in-line" have been documented, for example in W. Bald et al. "Innovative Technologie zur Banderzeugung", Stahl und Eisen 119 (1999) No. 3, pages 77 to 85, or C. Hendricks et al. "Inbetriebnahme und erste Ergebnisse der Gießwalzanlage der Thyssen Krupp Stahl AG", Stahl und Eisen 120 (2000) No. 2, pages 61 to 68.

However, even in the framework of conventional plant engineering for hot-rolling, including the pre- and intermediate rolling, an attempt is made in the use of conventional slabs to achieve hot strip thicknesses of ≦1.5 mm, see for example JP 2001 123225 A2.

The invention was based on the object of realising an economically producible hot strip with a partially softened structure with a thickness of at most 1.8 mm which, owing to these properties, is especially suitable for producing high-grade electrical sheets.

This object is achieved starting from the above-described prior art by a hot-rolled steel strip, which has the following composition (in % by weight):

C: <0.02%

Mn: ≦1.2%

Si: 0.1-4.4%

Al 0.1-4.4%, wherein the sum formed from the Si content and twice the Al content ([% Si]+2×[% Al]) is <5%,

P: <0.15%

Sn: ≦0.20%

Sb: ≦0.20%, the remainder iron and unavoidable impurities, the strip thickness of which steel strip is at most 1.8 mm, and which has a partially softened structure, which is characterised by a high intensity of the α fibre (fibre representation of orientation distribution functions) in the range to 60°.

The invention proceeds from the recognition that with a choice of a suitable method of production, a hot strip can be provided which already in the hot-rolled state has a structure which can be produced only by cold-rolling with high degrees of deformation in a conventional manner of production. Thus, a hot strip composed and made up according to the invention with a strip thickness of at most 1.8 mm has a partially softened structure. This structure is distinguished by high intensities of the α fibre in the range of angles up to 60° for specific positions, in other words in an angle range in which, in the case of conventional hot strips of comparable composition, no noteworthy intensities would be generally able to be established for these positions. The high intensities of the specific positions (112) <110> and (111) <110> are characteristic, wherein for the ratios of the intensities $I_{112}$ of the position (112) <110> to the intensity $I_{001}$ of the position (001) <110> a value>0.4 is produced and for the ratios of the intensity $I_{111}$ of the position (111) <110> to the intensity $I_{001}$ of the position (001) <110> a value>0.2 is produced. Owing to this composition, hot strip according to the invention can be processed in an excellent manner to form cold-rolled NO electrical sheet, the end thickness of which is typically 0.35 mm to 0.75 mm, in particular 0.2 mm, 0.35 mm, 0.50 mm or 0.65 mm.

Conventional hot strips differ from those according to the invention in that in the case of these noteworthy intensities only occur in the range of up to 25° (−30°), while for the components (112) <110> and (111) <110> no further higher intensities can be established. In the conventional hot strips, an intensity maximum of the α fibre structure is typically present at 0°, from which the intensity decreases with an increasing angle. This intensity distribution of the α fibre corresponds to a hardened structure. Only owing to the cold-rolling process is a softening of the structure achieved in the case of such steel strips by a recrystallisation in the subsequent annealing. For this purpose, degrees of total deformation of more than 65% are required which, on the one hand, assume a specific minimum thickness of the hot strip to be cold-rolled and, on the other hand, a considerable rolling power in the cold-deformation of the strip.

Hot strip according to the invention is composed in comparison such that the intensities of the component (112) <110> and the intensities of the position (111) <110> are high. At the same time, hot strip according to the invention has a particularly small end thickness. The hot strip according to the invention thus creates far more favourable conditions for the subsequent processing than the conventional hot strips can achieve. Thus, hot strip according to the invention starting from its small thickness of at most 1.8 mm with a minimised total deformation can be cold-formed into a non-grain oriented electrical sheet, the properties of which are at least equal to the properties of conventionally produced NO electrical sheets.

In relation to the terms used α fibre, intensity and position, it should be remembered that the texture of a crystalline phase is described quantitatively by means of the orientation distribution function.

The orientation distribution function describes the relative position of the crystal coordinate system and sample coordinate system. The orientation distribution function allocates each point in the space an orientation density or intensity. As representation of the orientation distribution function is very complicated and not very graphic, a simplified description is selected with the aid of fibres. The fibres relevant for steels are:

α fibre, γ fibre, η fibre, ζ fibre, δ fibre.

In the α fibre observed here, the <110> direction is parallel to the rolling direction; it extends between the positions (001) <110> and (110) <110>.

Hot strip according to the invention has a particular favourable softening state for further processing when its strip thickness is at most 1.2 mm. With hot strip according to the invention which is as thin as this, the ratio $I_{112}/I_{001}$ formed from the intensity $I_{112}$ of the position (112) <110> to the intensity $I_{001}$ of the position (001) <110> of the α fibre is >0.75 and the ratio $I_{111}/I_{001}$ formed from the intensity $I_{111}$ of the position (111) <110> to the intensity $I_{001}$ of the position (001) <110> of the α fibre is >0.4. Hot strip softened in this way can be processed with particularly small degrees of deformation into NO electrical sheet.

Hot strips according to the invention with hot strip thicknesses of ≦1.8 mm can be manufactured in various ways; conventional hot strip lines with possibilities for producing the above thicknesses, continuous casting and rolling plants (casting of thin slabs with subsequent in-line hot-rolling), thin strip casting plants with subsequent single or multi-stage hot-rolling of the thin strip.

According to an advantageous configuration of the method according to the invention, at least one pass of the hot-rolling is carried out at temperature, at which the hot strip has an austenitic structure, and a plurality of subsequent passes of the hot-rolling are carried out at temperatures in which the hot strip has a ferritic structure. Owing to rolling deliberately carried out in this way in the individual phase state regions, in particular in the case of converting alloys, hot strips can be produced which have optimised properties with respect to the demands placed on NO electrical sheets. It has been shown, for example, that owing to a suitable combination of the phase sequence in hot-rolling in conjunction with specific end rolling and coiler temperatures, a decisive raising of the magnetic polarisation can be achieved. To ensure that at least the last pass of the hot-rolling is carried out with a ferritic structure in the hot strip, the end rolling temperature during hot-rolling should be less than 850° C.

During the hot-rolling, at least during one of the last deformation passes, rolling is carried out with lubrication. Owing to the hot-rolling with lubrication, on the one hand, smaller shear deformations occur, so that the rolled strip receives a more homogeneous structure over the cross-section as a result. On the other hand, owing to the lubrication, the rolling forces are reduced, so that a greater reduction in thickness is possible over the respective rolling pass. Therefore, according to the desired properties of the electrical sheet to be produced, it may be advantageous if all the forming passes taking place in the ferrite region are carried out with a rolling lubrication.

Hot strips according to the invention, can be produced in particular with reliably reproducible working results in that initially a steel composed according to the invention is melted and then the steel is cast into thin slabs which are then continuously ("in-line") hot-rolled to form hot strip. The extent of total deformation achieved during the hot-rolling is preferably at least 90%, the hot-rolling generally being carried out in a plurality of passes.

The continuous sequence particular to known continuous casting and rolling, of casting the steel to form thin slabs and hot-rolling the thin slabs to form a hot strip, also allows working steps to be dispensed with in the production of hot strips according to the invention, as for example the reheating of the slabs and pre-rolling. Moreover, it has been shown that dispensing with the according working steps influences the material state in the various production phases. This sometimes differs considerably from that achieved in the conventional production of hot strip in which at the beginning the cooled slab is reheated. In particular it is the macro-segregations and the solution and precipitation state which differentiates hot strips produced according to the invention from those produced conventionally. In addition, the forming process during the hot-rolling takes place during continuous in-line casting and rolling in favourable thermal conditions. Thus, the rolling passes can be applied with higher degrees of deformation and the deformation conditions can be used in a targeted manner to control the structure development.

In the use of continuous casting and rolling in the hot strip according to the invention, the phosphorous content is preferably limited to less than 0.08% by weight in order to achieve adequate casting properties.

DETAILED DESCRIPTION OF THE INVENTION

The invention will be described hereinafter with the aid of embodiments. In FIG. 1, the curve of the orientation distribution function (orientation density) is plotted for three examples over the angle Φ. "Φ" is one of the eulerian angles which describe the relative position of the crystal coordination and sample coordination system. Special positions are simultaneously plotted: (001) <110>, (112) <110>, (111) <110> and others. To determine the properties of an example for a hot strip $Wb_E$ according to the invention and two comparison examples for hot strips $Wb_{v1}$ and $Wb_{v2}$ not according to the invention, a steel with (in % by weight or ppm by weight)<30 ppm C, 0.2% Mn, 0.050% P, 1.3% Si, 0.12% Al, 0.01% Si, and as the remainder Fe and impurities was melted.

In the case of the hot strip $Wb_{v1}$ manufactured for comparison, the melted steel is cast to form a slab, which is then cooled in a conventional manner, reheated, pre-rolled and hot-rolled to an end thickness of 2.5 mm. The hot strip $Wb_{v1}$ thus obtained, for an orientation angle Φ of 0° to 20°, had an orientation thickness of the α fibre determined in the strip centre, of at least 4, while the orientation thickness for angles Φ of more than 20° was regularly less than 3. The value of the ratio $I_{112}/I_{001}$ of the intensity $I_{112}$ of the position (112) <110> to the intensity $I_{110}$ of the position (001) <110> of the α fibre was accordingly likewise below 0.1 like the value of the ratio $I_{111}/I_{001}$ of the intensity $I_{111}$ of the component (111) <110> to the intensity $I_{110}$ of the component (001) <110>.

The curve of the orientation density over the angle Φ is shown in FIG. 1 for the hot strip $Wb_{v1}$ serving for comparison as a dotted line.

The high density in the region of small angles and the low density in the region of large angles prove that the hot strip $Wb_{v1}$ was in a hardened state in which it firstly has to be subjected to an expensive cold-rolling and after-treatment in order to be able to be used as a NO electrical sheet.

In order to produce the hot strip $Wb_{v2}$ also manufactured for comparison, the same steel is firstly cast in a continuous casting and rolling plant to form a thin slab which was then hot-rolled also "in-line" in a plurality of passes to a hot strip end thickness of 3 mm.

The hot strip $Wb_{v2}$ thus obtained, for an orientation angle Φ of 0° to 20°, like the hot strip $Wb_{v1}$, had an orientation density of the α fibre determined in the strip centre of at least 4, while the orientation density for angles Φ of more than 20° was regularly significantly less than 3. The value of the ratio $I_{112}/I_{001}$ of the intensity $I_{112}$ of the position (112) <110> to the intensity $I_{110}$ of the position (001) <110> of the α fibre was 0.2, while the value of the ratio $I_{111}/I_{001}$ of the intensity $I_{111}$ of the position (111) <110> to the intensity $I_{110}$ of the position (001) <110> only reached 0.06.

The curve of the orientation density over the angle Φ is shown in FIG. 1 as a dash-dot line for the hot strip $Wb_{v2}$ serving as a comparison.

In the case of the hot strip $Wb_{v2}$ the high density in the region of smaller angles, and the low density in the region of large angles, also proves that the hot strip $Wb_{v2}$ was in a hardened state in which it firstly had to be subjected to an extensive cold-rolling and after-treatment in order to be able to be used as NO electrical sheet.

The hot strip $Wb_E$ according to the invention is also produced from the same steel as the hot strip $Wb_{v1}$ manufactured for comparison. For this purpose, the relevant steel is also cast in a continuous casting and rolling plant to form a thin slab which is then also hot-rolled "in-line" in a plurality of passes. In contrast to the hot strip $Wb_{v2}$, the end thickness of the hot strip was only 1.04 mm, however.

The hot strip $Wb_E$ thus obtained for all orientation angles Φ in the range of 0° to 60°, had an orientation density of the α fibre determined in the strip centre of at least 4. The orientation density only dropped to below 3 in the angle range of more than 60°. The value of the ratio $I_{112}/I_{001}$ of the intensity $I_{112}$ of the position (112) <110> to the intensity $I_{110}$ of the component (001) <110> of the a fibre was at a high level, namely 0.81. In the same way, the value of the ratio $I_{111}/I_{001}$ of the intensity $I_{111}$ of the position (111) <110> to the intensity $I_{110}$ of the position (001) <110> reached a high level, namely 0.54.

The curve of the orientation density over the angle Φ is shown as a solid line in FIG. 1 for the hot strip $Wb_E$ according to the invention.

The high orientation densities up to an angle of 60° and the high intensities of the component (112) <110> and (111) <110> proves that the hot strip according to the invention is in a substantially partially softened state.

The invention claimed is:

1. A method for producing a hot strip
the method comprising the following working steps:
melting a steel with the following composition in % by weight:
C: <0.02%
Mn: ≦1.2%
Si: 0.1-4.4%
Al: 0.1-4.4%; wherein the sum formed from the Si content and twice the Al content is <5%,
P: <0.15%
Sn: ≦0.20%
Sb: ≦0.20%,
the remainder iron and unavoidable impurities, to form a steel melt;
casting the steel melt to form thin slabs;
continuous hot-rolling the thin slabs at a temperature of the thin slabs following the casting of the steel, the continuous hot rolling comprising a plurality of passes; and
wherein at least one pass of the hot-rolling is carried out at temperatures at which the hot strip consists of an austenitic structure, and a plurality of subsequent passes of the hot-rolling are carried out at temperatures in which the hot strip consists of a ferritic structure.

2. The method of claim 1, wherein the phosphorous content in the hot strip is <0.08% by weight.

3. The method of claim 1, wherein the degree of total deformation achieved during the hot-rolling is at least 90%.

4. A method for producing a hot strip
the method comprising the following working steps:
melting a steel with the following composition in % by weight:
C: <0.02%
Mn: ≦1.2%
Si: 0.1-4.4%
Al: 0.1-4.4%; wherein the sum formed from the Si content and twice the Al content is <5%,
P: <0.15%
Sn: ≦0.20%
Sb: ≦0.20%,
the remainder iron and unavoidable impurities, to form a steel melt;
casting the steel melt to form a thin strip;
continuous hot-rolling following the casting of the steel in one or more passes; and
wherein at least one pass of the hot-rolling is carried out at temperatures at which the hot strip consists of an austenitic structure, and a plurality of subsequent passes of the hot-rolling are carried out at temperatures in which the hot strip consists of a ferritic structure.

5. The method of claim 1, wherein the temperature during hot-rolling is less than 850° C.

6. The method of claim 1, further comprising carrying out with lubrication at least the last hot rolling pass during the hot rolling step is at a temperature within the ferrite region.

7. A method for producing non-grain oriented electrical sheet from a hot strip comprising the following composition in % by weight:

C: <0.02%

Mn: <1.2%

Si: 0.1-4.4%

Al: 0.1-4.4%; wherein the sum formed from the Si content and twice the Al content is <5%

P: <0.15%

Sn: ≦0.20%

Sb: ≦0.20% the remainder iron and unavoidable impurities, with a strip thickness which is at most 1.8 mm, and with a partially softened structure which is characterized by a high intensity of an orientation density in the region of 0° to 60°, wherein the ratio $I_{112}/I_{001}$ formed from the intensity $I_{112}$ of the position (112) <110> to the intensity $I_{001}$ of the position (001) <110> is >0.4 and the ratio $I_{111}/I_{001}$ formed from the intensity $I_{111}$ of the position (111) <110> to the intensity $I_{001}$ of the position (001) <110> is >0.2 and produced according to claim 4, further comprising the following working steps:

pickling or annealing and pickling of the hot strip;

cold-rolling of the hot strip;

intermediate annealing of the cold strip; and final annealing or annealing with subsequent deformation with a total degree of deformation of less than 20%.

8. The method of claim 7, further comprising carrying out the cold rolling in at least two stages with an intermediate annealing.

* * * * *

UNITED STATES PATENT AND TRADEMARK OFFICE

CERTIFICATE OF CORRECTION

PATENT NO. : 7,658,807 B2
APPLICATION NO. : 10/493522
DATED : February 9, 2010
INVENTOR(S) : Karl Ernst Friedrich et al.

It is certified that error appears in the above-identified patent and that said Letters Patent is hereby corrected as shown below:

Title Page, (*) Notice: Subject to any disclaimer, the term of this patent is extended or adjusted under 35 U.S.C. 154(b) by 454 days.

should read (*) Notice: Subject to any disclaimer, the term of this patent is extended or adjusted under 35 U.S.C. 154(b) by 765 days.

In claim 1, at column 6, line 19, delete "≦" and replace it with --≤--.

In claim 1, at column 6, line 24, delete "≦" and replace it with --≤--.

In claim 1, at column 6, line 25, delete "≦" and replace it with --≤--.

In claim 4, at column 6, line 46, delete "≦" and replace it with --≤--.

In claim 4, at column 6, line 51, delete "≦" and replace it with --≤--.

In claim 4, at column 6, line 52, delete "≦" and replace it with --≤--.

In claim 7, at column 7, line 10, delete "≦" and replace it with --≤--.

In claim 7, at column 7, line 11, delete "≦" and replace it with --≤--.

In claim 7, at column 8, line 5, delete "4" and replace it with --1--.

Signed and Sealed this

Eighteenth Day of May, 2010

David J. Kappos

David J. Kappos
*Director of the United States Patent and Trademark Office*